US010071839B2

(12) United States Patent
Harmon et al.

(10) Patent No.: US 10,071,839 B2
(45) Date of Patent: Sep. 11, 2018

(54) PROBIOTIC CANNING SYSTEM

(71) Applicants: Michael Harmon, Port Lavaca, TX (US); Sheila Jernigan, Port Lavaca, TX (US)

(72) Inventors: Michael Harmon, Port Lavaca, TX (US); Sheila Jernigan, Port Lavaca, TX (US)

( * ) Notice: Subject to any disclaimer, the term of this patent is extended or adjusted under 35 U.S.C. 154(b) by 82 days.

(21) Appl. No.: 15/284,264

(22) Filed: Oct. 3, 2016

(65) Prior Publication Data

US 2017/0096267 A1 Apr. 6, 2017

Related U.S. Application Data

(60) Provisional application No. 62/235,824, filed on Oct. 1, 2015.

(51) Int. Cl.

| | |
|---|---|
| ***B65D 39/00*** | (2006.01) |
| ***B65D 51/14*** | (2006.01) |
| ***B65D 1/10*** | (2006.01) |
| ***B65D 51/16*** | (2006.01) |
| ***B65D 53/02*** | (2006.01) |
| ***B65D 51/26*** | (2006.01) |

(52) U.S. Cl.

CPC ..... *B65D 51/145* (2013.01); *B65D 1/10* (2013.01); *B65D 51/165* (2013.01); *B65D 51/26* (2013.01); *B65D 53/02* (2013.01)

(58) Field of Classification Search

CPC .. B65D 51/145; B65D 83/0011; B65D 45/28; B65D 51/26; B65D 1/10

See application file for complete search history.

(56) References Cited

U.S. PATENT DOCUMENTS

| | | | | | |
|---|---|---|---|---|---|
| 1,382,985 | A * | 6/1921 | Kipp | B65D 45/28 | 215/283 |
| 2,387,978 | A * | 10/1945 | Casey | B65D 81/2038 | 215/12.1 |
| 3,580,409 | A * | 5/1971 | Soboleski | B65D 51/26 | 215/231 |
| 3,991,897 | A * | 11/1976 | Meyers | B65D 45/28 | 215/230 |
| 4,116,352 | A * | 9/1978 | Davis | B65D 51/145 | 215/270 |
| 9,022,258 | B2 * | 5/2015 | Nehren | B01F 13/1055 | 222/390 |
| 9,636,235 | B2 * | 5/2017 | Hensler | A61F 2/46 | |

* cited by examiner

*Primary Examiner* — Shawn M Braden

(74) *Attorney, Agent, or Firm* — Law Office of Jeff Williams; J. Oliver Williams

(57) ABSTRACT

A canning system for a jar is described. The system includes a plunger configured to translate through a neck of the jar. A seal is in communication with the plunger and configured to flex its shape so as to conform to the size of the jar as it passes through the neck. The seal extending beyond the periphery of the plunger. A rod is configured to engage the plunger and selectively locate the position of the plunger within the jar. An optional cap may be used to assist in locating the plunger in the jar prior to sealing the jar with a lid.

10 Claims, 4 Drawing Sheets

PROBIOTIC CANNING SYSTEM

CLAIM OF PRIORITY

This application claims the benefit of U.S. Provisional Application No. 62/235,824, filed 1 Oct. 2015. The information contained therein is hereby incorporated by reference.

BACKGROUND

1. Field of the Invention

The present application relates generally to a canning system, and in particular to a canning system having a no-float insert device within the jar.

2. Description of Related Art

The process of fermenting food or canning food has been around for a long time. The act of fermenting or canning is partly done to help preserve foods for extended periods of time. The fermenting of foods can also introduce healthy microbes into the food, acting to help preserve the food, but can also provide health benefits. The microbes consist of an assortment of bacteria and yeasts. When it is done properly, the healthy bacteria tends to grow faster than unhealthy bacteria. Other terms used for fermenting foods can be: Cultured, Cured, Pickled, and Brined. Commonly fermented foods are: Sauer Kraut, Vinegar, Pickles, Milk, Salsa, Mustard, many types of condiments, Ketchup, Bread yeasts, and Hummus for example.

The fermenting process is fairly well known in the art. First the food is prepared for insertion into the container. Second, ensure you have clean containers. The containers are often canning jars (glass jars with sealed lids). Third, pack the food into the jar and eliminate any bubbles or trapped air. Fourth, locate the food below the liquid surface depending on the use of open or closed fermenting. Make sure the food stays under the surface of the liquid if it is a brined food. If food pops to the surface or is exposed then mold may develop, the food may dry out, and other problems in fermenting are experienced. Fifth, leave the food to sit for the preferred amount of time.

There is a difficulty in maintaining the food below the surface of the liquid when fermenting. In an effort to overcome this, some individuals try to push down the food with a weight. This is not very effective because the food is not always level or remains level if transported. Shifting food or a shifting weight can open paths for food to float to the surface. To correct for this, an individual has to open the jar and readjust the food, which is less than desirable.

Although great strides have been made with respect to the fermenting process, considerable shortcomings remain. A canning system that fits existing jars and does not shift in the jar is needed to properly maintain the food below the liquid surface.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
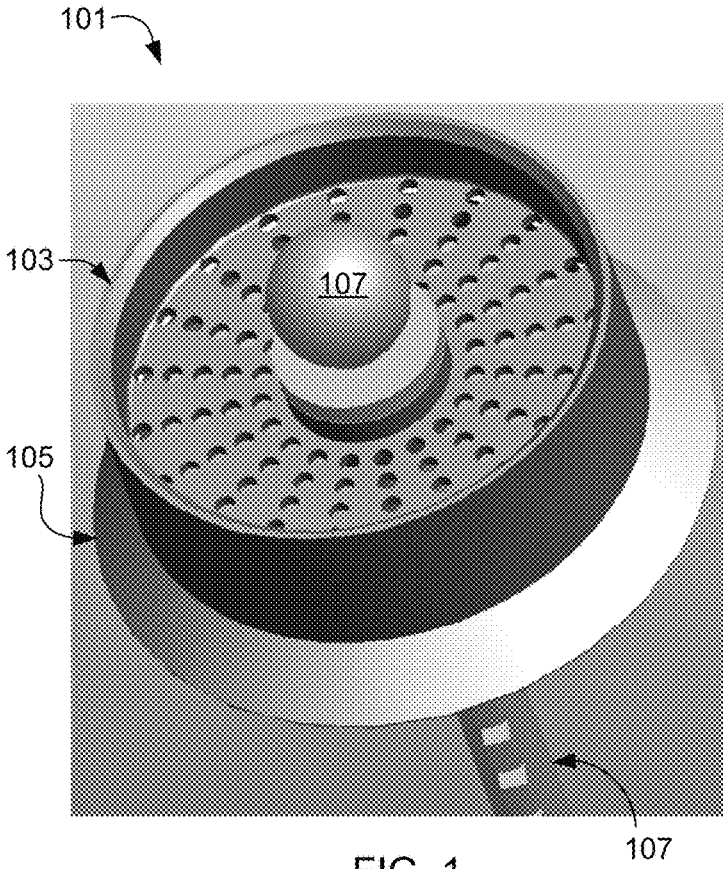
FIG. 1 is an upper perspective view of a probiotic canning system according to a preferred embodiment of the present application.

While the device and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The device in accordance with the present application overcomes one or more of the above-discussed problems commonly associated with conventional fermenting and canning systems. Specifically, the probiotic canning system of the present application is configured to pass through the neck of a jar and securely retain the food beneath the liquid surface. These and other unique features of the device are discussed below and illustrated in the accompanying drawings.

The system will be understood, both as to its structure and operation, from the accompanying drawings, taken in conjunction with the accompanying description. It should be understood that various components, parts, and features of the system may be combined together and/or interchanged with one another, all of which are within the scope of the present application, even though not all variations and particular embodiments are shown in the drawings. It should also be understood that the mixing and matching of features, elements, and/or functions is expressly contemplated herein so that one of ordinary skill in the art would appreciate from this disclosure that the features, elements, and/or functions of one embodiment may be incorporated into another embodiment as appropriate, unless otherwise described.

As seen in FIGS. 1-7, wherein like reference characters identify corresponding or similar elements in form and function, the system of the present application includes a plunger 103, a seal 105, a rod 107, and a cap 109. Probiotic canning system 101 is configured to be made from durable food grade plastic/rubber parts. Other materials may include stainless steel and silicone. System 101 is designed to fit inside the neck of the jar and expand in diameter within the jar, so as to hold down food below the liquid surface. Portions of system 101 may be closed within a sealed jar during fermenting and removed at a later time. The parts of system 101 may be reused over and over with different types of food. It is understood that system 101 may be operable with all different types of fermenting and canning processes and is not restricted to only one kind. Additionally, system 101 may operate with airlocks having one way valves and other types of fermenting/canning devices.

Figure 2:
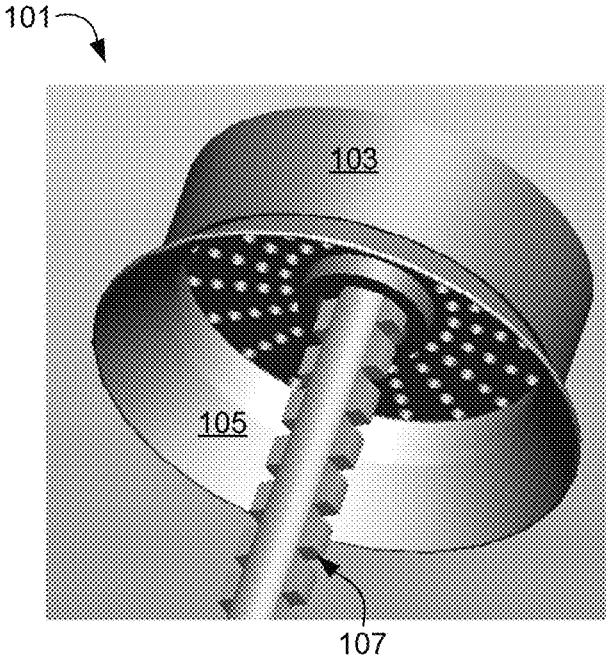
FIG. 2 is a lower perspective view of the probiotic canning system of FIG. 1.

Referring now to FIGS. 1 and 2 in the drawings, perspective views of system 101 are illustrated. As stated previously, system 1 includes a plunger 103, seal 105, and rod 107. Plunger 103 is configured to be a rigidly formed member configured to hold its shape and permit pressure to be applied to food within the jar without experiencing excessive flexure or breakage. Seal 105 is configured to couple to a portion of plunger 103 and expand against the walls of the jar after passing the neck of the jar. Rod 107 is used to pass through plunger 103 and is designed to selectively locate plunger 103 within the jar to ensure the food remains below the liquid surface. Rod 107 may be trimmed or selectively sized by a user to ensure that it fits within the jar. Plunger 103, seal 105, and rod 107 are configured to remain within the jar during the fermenting process wherein the jar has a sealed lid installed.

Figure 3:
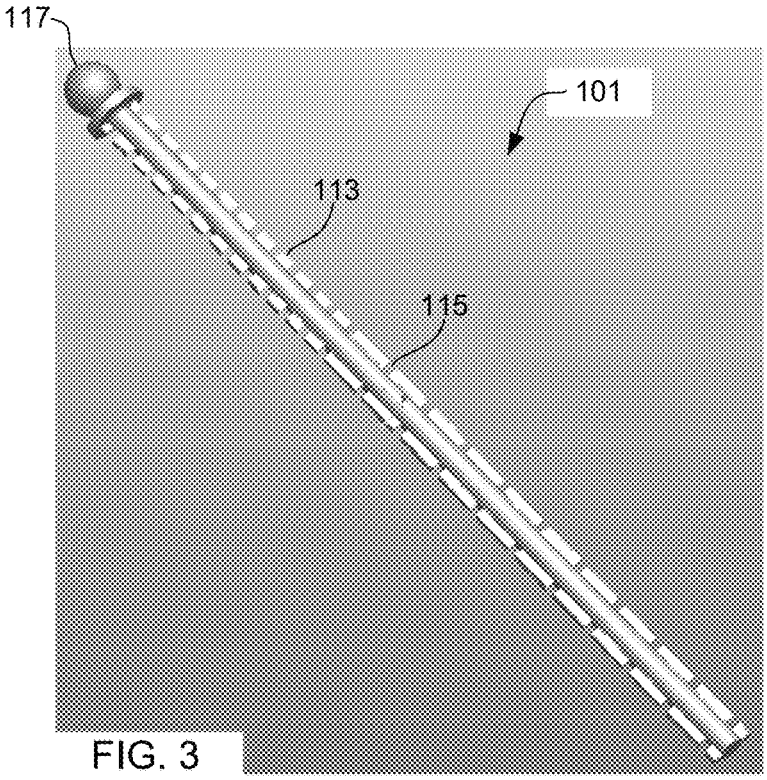
FIG. 3 is a side view of a rod used in the probiotic canning system of FIGS. 1 and 2.

Referring now also to FIG. 3 in the drawings, rod 107 is illustrated in more detail. Rod 107 is configured to include one or more tabs 113 selectively spaced along its length. The spacing of tabs 113 form one or more gaps 115. Rod 107 is configured to selectively engage the one or more tabs 113 and gaps 115 with plunger 103 as a method of adjusting the height or location of plunger 103 and seal 105 within jar 102. A handle portion 117 is located above plunger 103 and is operated by an individual to selectively rotate and secure rod 107 within plunger 103. When secured, the user may push down on handle portion 117 and push plunger 103 into the jar. Many gaps 115 and tabs 113 are located along the length of rod 107 to provide proper height adjustments. The tabs 113 and gaps 115 can be different sizes along the length of rod 107. Additionally, the length of rod 107 may be adjusted to the height and size of jar 102. This is done by trimming rod 107.

Figure 4:
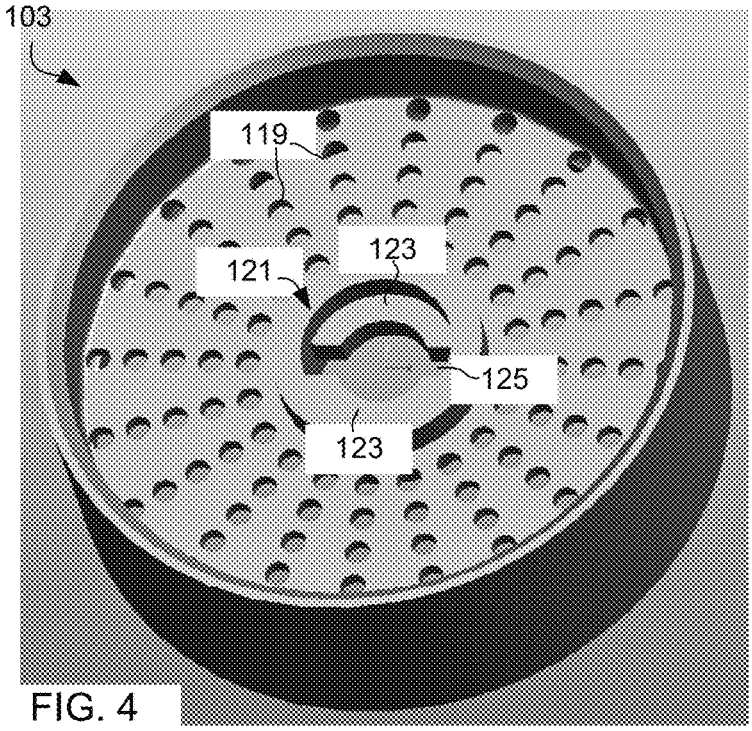
FIG. 4 is an upper perspective view of a plunger in the probiotic canning system of FIGS. 1 and 2.

Referring now also to FIG. 4 in the drawings, plunger 103 is illustrated and described in more detail. Plunger 103 is a rigid member configured to be sized just smaller than the internal neck portion of jar 102. Plunger 103 includes a number of vent holes 119 to permit the passage of liquid and gas but small enough to prevent the passage of food. Plunger 103 may be adapted to allow for the adjustment in sizing and pattern of holes 119. This may be done by using an adjustable and removable screen or cover. Additionally, the holes 119 may include vent closures to allow the user to partially close or open certain holes 119.

Plunger 103 further includes rod attachment portion 121. Portion 121 is configured to accept rod 107. Portion 121 can be formed and operated in many different types of methods. One such way is by using an opposing set of flanges 123 that form slots 125. Tabs 113 of rod 107 is configured to pass through slots 125 and alternatively configured to contact flanges 123 depending on their respective orientation within portion 121. In a first orientation, tabs 113 are rotated (along with rod 107) such that the tabs align with slots 125. In this orientation, rod 107 is permitted to translate through portion 121. Here the tabs 113 are disengaged from the flanges 123. In a second orientation, rod 107 is rotated to restrict the translation of rod 107 through portion 121. Tabs 113 contact either or both an upper or lower surface of flanges 123. Here the tabs 113 are engaged with flanges 123. Flanges 123 are configured to pass through gaps 115. In this orientation a user may push or pull plunger 103, thereby locating it within jar 102.

Figure 5:
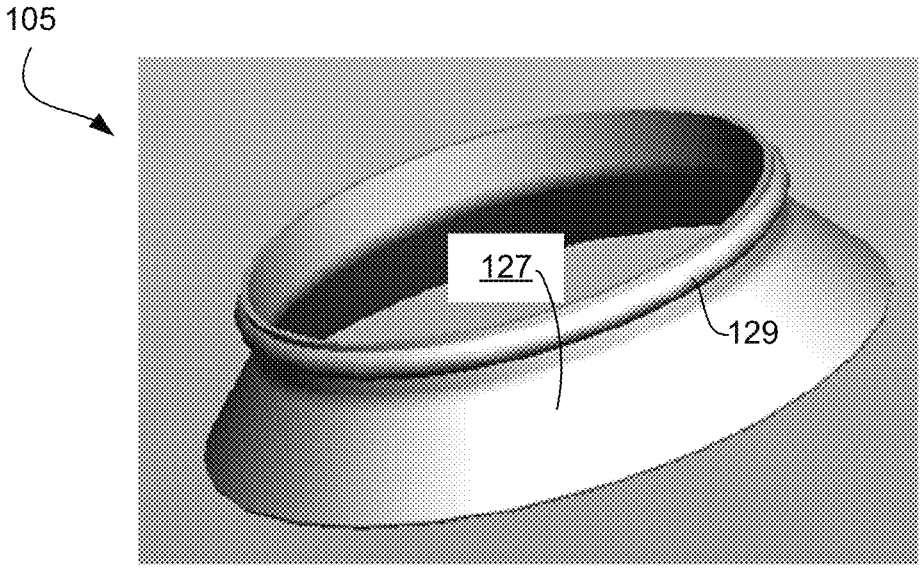
FIG. 5 is an upper perspective view of a seal in the probiotic canning system of FIGS. 1 and 2.

Referring now also to FIG. 5 in the drawings, seal 105 is illustrated and described in more detail. Seal 105 is configured and made from a pliable and conforming material (i.e. rubber) that allows it to flex and adapt to the contours of jar 102. Seal 105 includes a skirt 127 configured to extend beneath or away from plunger 103. Seal 105 releasably couples to plunger 103 to allow for the customizable application within each jar so as to accommodate for various diameters and ratios between neck diameters and body diameters. This is done in many different types of ways. An exemplary way is if seal 105 further includes a rib 129 configured to couple to a groove 131 (see FIG. 6) in plunger 103. Other methods are contemplated, such as using tabs, slots, ports or holes to name a few. Seal 105 extends beyond plunger 103 and contacts portions the internal sides of jar 102. The flexible nature of seal 105 allows it to reach out to the sides of the body of jar 102 and contract when passing through the neck portion of jar 102.

Figure 6:
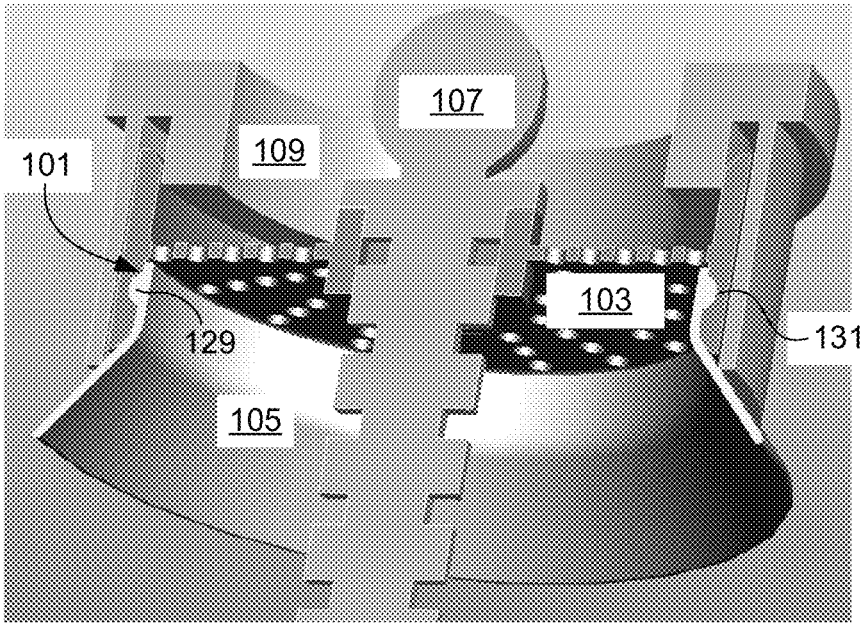
FIG. 6 is a lower perspective section view of the probiotic canning system of FIGS. 1 and 2.

Referring now also to FIG. 6 in the drawings, an enlarged view of system 101 including cap 109 is illustrated. Plunger 103 is configured to translate within the internal surfaces of cap 109. Cap 109 is placed on jar 102 and the user locates plunger 103 by adjusting and applying the necessary forces to rod 107. As stated previously, a user may trim rod 107 to fit the size of jar 102. When positioned appropriately, cap 109 is removed and a lid is coupled to jar 102. Any one of plunger 103, seal 105, and rod 107 may be sealed inside jar 102.

Figure 7:
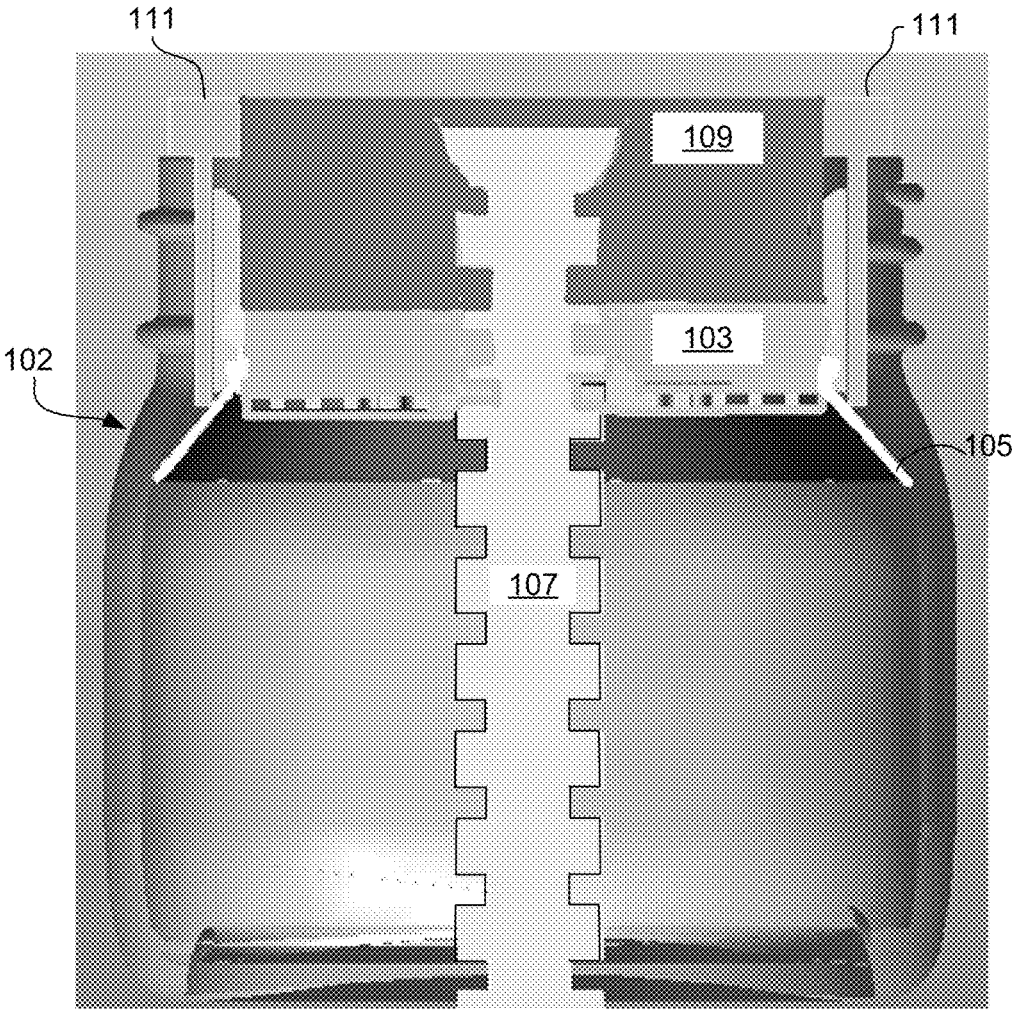
FIG. 7 is a side section view of the probiotic canning system of FIG. 6 in a jar.

Referring now also to FIG. 7 in the drawings, a side section view of system 101 with cap 109 is illustrated within jar 102. System 101 optionally includes cap 109. Cap 109 is configured to translate partially within the neck portion of jar 102 with plunger 103. Cap 109 is prevented from passing all the way through due to the use of an exterior flange 111 which is configured to rest on and over the surface of the rim of the neck. Plunger 103, seal 105, and rod 107 are configured to rest within the internal portions of cap 109 prior to insertion within jar 102. Cap 109 helps to ensure that seal 105 is oriented appropriately to ensure a smooth transition into jar 102 and through the neck portion.

The system of the present application includes a number of advantages, such as at least the following: 1) internally located plunger and seal; 2) food grade plastics; 3) selective adjustment of plunger in the jar; 4) customizable length of the rod; and 5) reusable after opening to keep food below the surface of the liquid.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A canning system for a jar, comprising:

a plunger configured to translate through a neck of the jar, the plunger includes one or more vent holes to permit the passage of a liquid within the jar, the vent holes are selectively adjustable to operate between an open and closed position;

a seal in communication with the plunger and configured to flex its shape so as to conform to the size of the jar, the seal extending beyond a periphery of the plunger; and a rod configured to engage the plunger and selectively locate the position of the plunger within the jar.

2. The system of claim 1, wherein the plunger seal and rod rest within the jar.

3. The system of claim 1, wherein at least one of the plunger, the seal, and the rod are sealed within the jar.

4. The system of claim 1, wherein the plunger and the seal are configured to maintain the submersion of objects within the liquid in the jar.

5. The system of claim 1, wherein the seal extends to the inner surface of the jar.

6. The system of claim 1, wherein the length of the rod is determined by the size of the jar.

7. The system of claim 1, wherein the rod includes a plurality of tabs to correspond with a gap in the plunger, the plurality of tabs being notched to permit selective engagement with the gap.

8. The system of claim 1, wherein the rod is configured to translate within the gap when the tabs are disengaged from the gap.

9. The system of claim 1, further comprising:

a cap configured to releasably engage the plunger and contact a rim of the neck of the jar.

10. The system of claim 9, wherein the cap is configured to assist in locating the plunger.

* * * * *